US006614012B2

(12) United States Patent
Schneider et al.

(10) Patent No.: US 6,614,012 B2
(45) Date of Patent: Sep. 2, 2003

(54) PRECISION-GUIDED HYPERSONIC PROJECTILE WEAPON SYSTEM

(75) Inventors: Arthur J. Schneider, Tucson, AZ (US); Ralph H. Klestadt, Tucson, AZ (US); David A. Faulkner, Tucson, AZ (US)

(73) Assignee: Raytheon Company, El Segundo, CA (US)

( * ) Notice: Subject to any disclaimer, the term of this patent is extended or adjusted under 35 U.S.C. 154(b) by 86 days.

(21) Appl. No.: 09/795,577

(22) Filed: Feb. 28, 2001

(65) Prior Publication Data

US 2003/0057320 A1 Mar. 27, 2003

(51) Int. Cl.[7] ..... F42B 15/22

(52) U.S. Cl. ..... 244/3.1

(58) Field of Search ..... 244/3.15, 3.16, 244/3.24, 3.17, 3.1; 102/489, 517, 518

(56) References Cited

U.S. PATENT DOCUMENTS

| | | | | | |
|---|---|---|---|---|---|
| 3,844,506 | A | * | 10/1974 | Stavis et al. | 244/3.15 |
| 4,021,801 | A | * | 5/1977 | Chernick | 244/3.19 |
| 4,111,382 | A | * | 9/1978 | Kissinger | 244/3.1 |
| 4,142,695 | A | * | 3/1979 | Remmell et al. | 244/3.14 |
| 4,522,356 | A | * | 6/1985 | Lair et al. | 102/489 |
| 4,728,057 | A | | 3/1988 | Dunne | 244/3.16 |
| 4,815,682 | A | * | 3/1989 | Feldmann et al. | 102/521 |
| 4,898,341 | A | * | 2/1990 | Terzian | 244/3.16 |
| 5,289,993 | A | * | 3/1994 | McWilliams et al. | 244/3.15 |
| 5,431,106 | A | * | 7/1995 | Dunn et al. | 102/357 |
| 5,554,994 | A | | 9/1996 | Schneider | 342/357 |

(List continued on next page.)

FOREIGN PATENT DOCUMENTS

WO 83/03894 11/1983

OTHER PUBLICATIONS

International Search Report dated Jan. 20, 2003 for PCT/US02/06102.

*Primary Examiner*—Peter M. Poon
*Assistant Examiner*—Susan Piasak
(74) *Attorney, Agent, or Firm*—Renner, Otto, Boisselle & Sklar, LLP

(57) ABSTRACT

A precision-guided hypersonic projectile weapon system. The inventive system includes a first subsystem for determining a target location and providing data with respect thereto. A second subsystem calculates trajectory to the target based on the data. The projectile is then launched and guided in flight along the trajectory to the target. In the illustrative application, the projectile is a tungsten rod and the first subsystem includes a forward-looking infrared imaging system and a laser range finder. The second subsystem includes a fire control system. The fire control system includes an optional inertial measurement unit and predicts target location. The projectile is mounted in a missile launched from a platform such as a vehicle. After an initial burn, the missile launches the projectile while in flight to the target. The missile is implemented with a rocket with a guidance system and a propulsion system. In accordance with the present teachings, the guidance system includes a transceiver system mounted on the projectile. The transceiver system includes a low-power continuous wave, millimeter wavelength wave emitter. A system is included at the launch platform for communicating with the projectile. The platform system sends a blinking command to the projectile and measures the round trip delay thereof to ascertain the range of the projectile. Velocity is determined by conventional Doppler techniques or differentiation. Azimuth and elevation are then determined by a monopulse antenna on the launch platform. As a consequence, the platform ascertains the location of the projectile and the impact point thereof. The platform generates a command to the projectile which is received by the projectile and used to actuate control surfaces to adjust the trajectory and impact point thereof as necessary.

31 Claims, 3 Drawing Sheets

U.S. PATENT DOCUMENTS 5,577,431 A * 11/1996 Kusters ..... 102/393
5,669,581 A * 9/1997 Ringer ..... 244/3.16
5,685,504 A * 11/1997 Schneider et al. ..... 244/3.11
5,762,290 A 6/1998 Dupont ..... 244/3.15
5,788,180 A * 8/1998 Sallee et al. ..... 244/3.15
5,907,117 A * 5/1999 Persson et al. ..... 102/388
5,917,442 A * 6/1999 Manoogian ..... 244/3.14
5,955,689 A * 9/1999 Feiten et al. ..... 84/312 R
6,016,990 A 1/2000 Small ..... 244/3.11
6,181,988 B1 1/2001 Schneider et al. ..... 701/3

* cited by examiner

PRECISION-GUIDED HYPERSONIC PROJECTILE WEAPON SYSTEM

BACKGROUND OF THE INVENTION

1. Field of Invention

This invention relates to missile guidance systems and methods. Specifically, the present invention relates to systems and methods for guiding hypersonic projectiles.

2. Description of the Related Art

The U.S. Army has shown that a tungsten long-rod penetrator delivering in excess of 10 megajoules of energy at hypersonic velocity to the armor of a tank can penetrate the armor and destroy the tank. This has involved boosting the rod to hypersonic speed using a rocket. For guidance, hypervelocity anti-tank weapon prior art has focused on the use of laser beam-rider guidance technology. Unfortunately, the rocket has heretofore left a large exhaust plume which has been impenetrable by optical, laser or infrared (IR) band energy to provide guidance commands from the launch platform. Thus the target is obscured when guidance is required.

Millimeter wave radar can penetrate the plume but usually does not offer sufficient resolution to provide the degree of guidance accuracy required.

Weapon system designers have consequently been forced to go to extraordinary means to deal with these difficulties, including commanding offset flight trajectories. These design concessions result in increased system complexity, compromised performance, and higher cost.

Thus, a need remains in the art for a weapon system that avoids the optical, laser, and IR transmissivity problems associated with a large rocket motor exhaust plume, allowing optimized performance and a greatly simplified weapon system at lower cost.

SUMMARY OF THE INVENTION

The need in the art is addressed by the hypervelocity projectile guidance system of the present invention. The inventive system includes a first subsystem for determining a target location and providing data with respect thereto. A second subsystem calculates trajectory to the target based on the data. The projectile is then launched and guided in flight along the trajectory to the target.

In the illustrative application, the projectile is a tungsten rod and the first subsystem includes a forward-looking infrared (FLIR) imaging system and a laser range finder. The second subsystem includes a fire control system. The fire control system predicts target location and may include an optional inertial measurement unit. The projectile is mounted in a missile launched from a platform such as a launch vehicle. The missile is implemented with a guidance system and a propulsion system. After an initial burn, the missile launches the projectile while in flight.

In accordance with the present teachings, the guidance system includes a transceiver system mounted on the projectile. The transceiver system includes a low-power, continuous-wave, millimeter wavelength wave emitter. A system is included at the launch platform for communicating with the projectile. The platform system sends a blinking command to the projectile and measures the round trip delay thereof to ascertain the range of the projectile. Velocity is determined by conventional Doppler techniques or differentiation. Azimuth and elevation are then determined by a monopulse antenna on the launch platform. As a consequence, the platform ascertains the location of the projectile and the impact point thereof. The platform generates a command to the projectile which is received by the projectile and used to actuate aerodynamic control surfaces or radial impulse motors ahead or behind the center of gravity to adjust the trajectory and impact point thereof as necessary.

DESCRIPTION OF THE INVENTION

An illustrative embodiment will now be described with reference to the accompanying drawings to disclose the advantageous teachings of the present invention.

Figure 1:
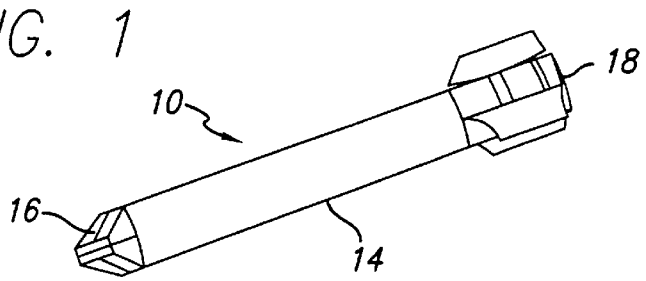
FIG. 1 is a perspective view of an illustrative implementation of a hypervelocity missile in accordance with the teachings of the present invention.
Figure 1A:
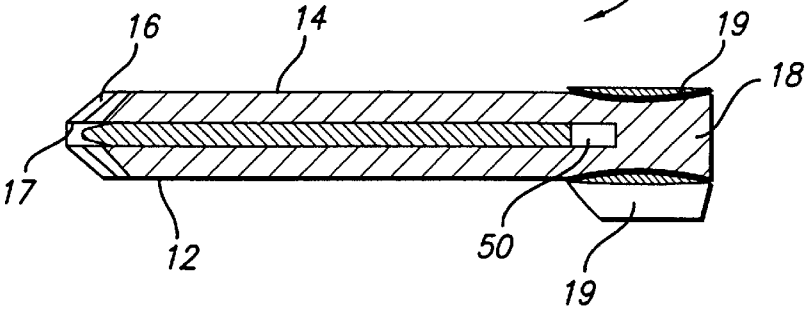
FIG. 1*a* is a sectional side view of a missile incorporating the teachings of the present invention.

FIG. 1 is a perspective view of an illustrative implementation of a hypervelocity missile in accordance with the teachings of the present invention. FIG. 1*a* is a sectional side view of a missile incorporating the teachings of the present invention. In the illustrative embodiment, the system is similar to the system disclosed in U.S. Pat. No. 5,005,781 entitled IN-FLIGHT RECONFIGURABLE MISSILE CONSTRUCTION, issued on Apr. 9, 1991 by Baysinger et al., the teachings of which are incorporated herein by reference. As shown in FIGS. 1 and la, the missile 10 includes a tungsten rod or projectile 12. (Those skilled in the art will appreciate that the present invention is not limited to the material construction of the rod 12.) The tungsten rod 12 is contained within a rocket motor case 14. Stabilization fins 16 for the rod 12 are located at the front end of the motor case 14. A fin attachment ring 17 is disposed in the nose of the missile. The ring 17 is secured to the fins 16 and engages the end of the rod 12 when the rod exits the casing 14. As disclosed more fully below, uniquely and in accordance with the present teachings, the rod 12 carries millimeter wave emitters and a command receiver shown generally as an electronic subsystem 50 disposed at the end of the rod/projectile 12.

Figure 1B:
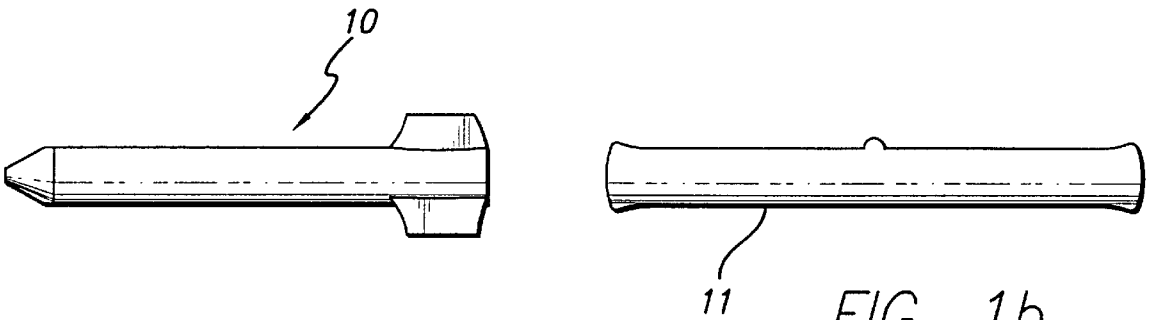
FIG. 1*b* is a diagram showing the missile relative to a launch tube.

FIG. 1*b* is a diagram showing the missile relative to a launch tube. As shown in FIG. 1*b*, the missile 10 fits into a shipping container/launch tube 11.

In the preferred embodiment, after launch, the rocket motor 18 (FIG. 1*a*) bums rapidly (e.g. between 0.5 seconds and 1 second), propelling the missile 10 to velocities of Mach 5 or greater. In the preferred embodiment, the rocket motor 18 nozzle/fins 19 are curved to induce a roll rate during the boost phase to average out any aerodynamic or thrust misalignments.

When the rocket motor 18 burns out, the motor case 14 is decelerated rapidly by aerodynamic drag forces. However, the heavy tungsten rod 12 with its high ballistic coefficient is immediately separated from the motor case 14, thereby maintaining its velocity. On the way out of the motor case 14, a slight conical taper on the tail end of the rod 12 engages and secures the stabilization fins 16, forming an arrow-like configuration. This is depicted in the diagram of FIG. 1*c*.

Figure 1C:
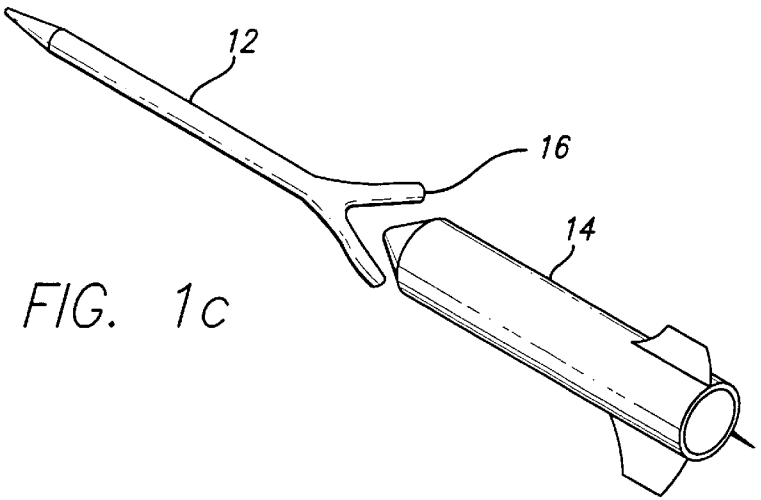
FIG. 1*c* is a diagram showing the separation of the rod from missile after rocket burn.

FIG. 1*c* is a diagram showing the separation of the rod from missile after rocket burn. The fins 16 on the penetrator 12 are canted to maintain a roll rate throughout the rest of the flight to the target.

The precision-guided hypersonic projectile weapon system of the present invention builds upon the Guided Penetrator System concept in devising a means by which the projectile may be guided along a predetermined trajectory. Unlike command to line-of-sight (CLOS) systems that typify the prior art, the present invention utilizes a unique command to ballistic trajectory (CBT) approach as is disclosed more fully below.

Figure 2:
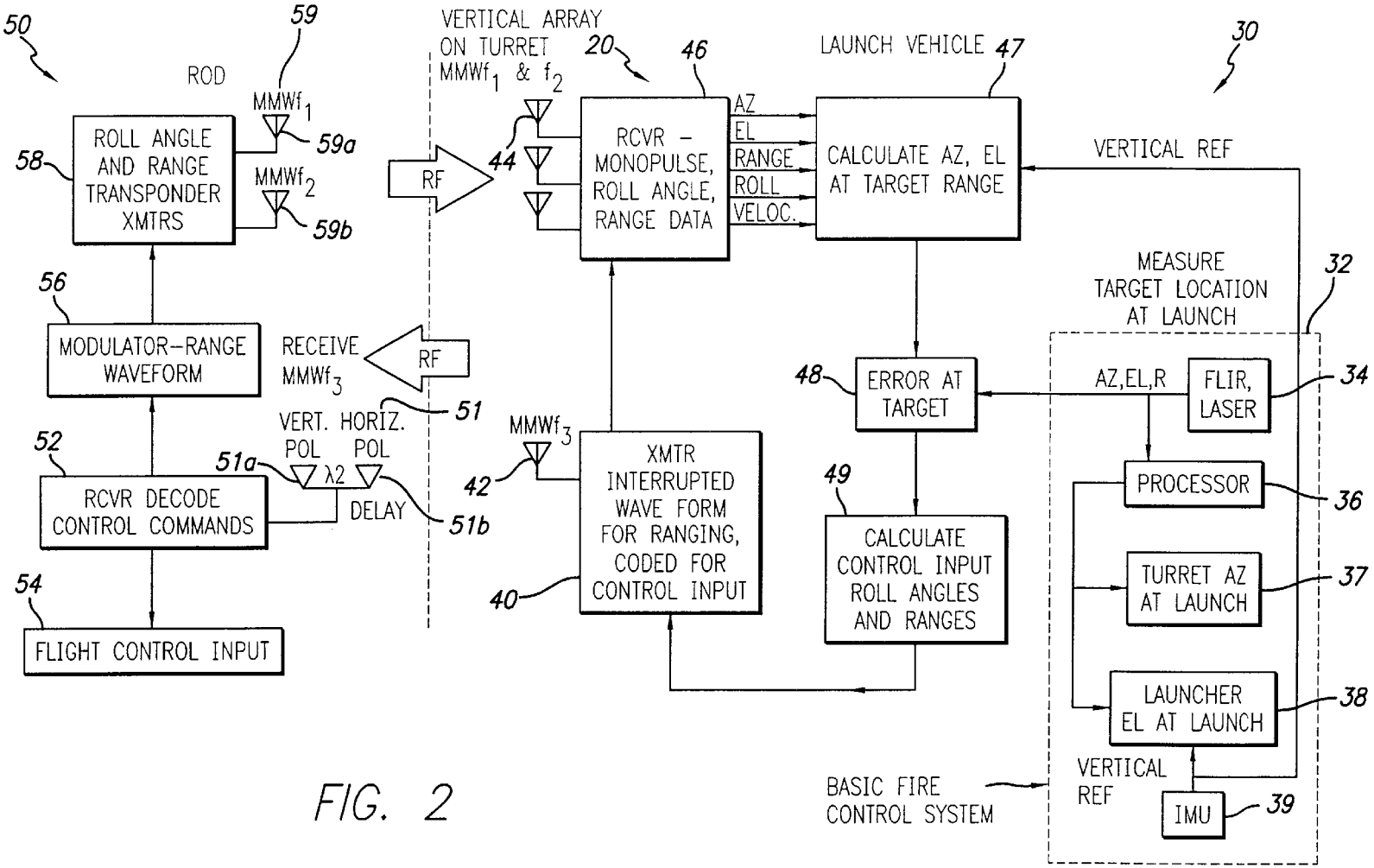
FIG. 2 is a block diagram of the missile guidance system of the present invention.

FIG. 2 is a block diagram of the missile guidance system of the present invention. The system 20 includes a launch vehicle subsystem 30 and a projectile subsystem 50. The launch vehicle subsystem 30 includes a base fire control system 32. The fire control system 32 may be of conventional design. In the illustrative embodiment, the fire control system 32 includes a target location subsystem 34 comprising, in the illustrative embodiment, a FLIR imager and a laser range finder. The target location subsystem 34 outputs target azimuth, elevation and range information to a processor 36 which adjusts the input data in response to stored calibration data and outputs commands to a launch turret azimuth control system 37 and a launch turret elevation control system 38. An optional inertial measurement unit (IMU) 39 provides vertical and horizontal reference signals which may be used by the processor 36 to adjust the launcher turret in azimuth and elevation and thereby compensate for any movement of the launch vehicle.

The launch vehicle subsystem 30 includes a transmitter 40 which radiates millimeter wave energy to the projectile subsystem via a first antenna 42. Return signals from the projectile are received by a second antenna 44, implemented as a phased array of small polarized monopulse antenna elements, and passed to a receiver/computer 46. This receiver/computer continuously computes projectile roll angle in accordance with U.S. Pat. No. 6,016,990 entitled ALL-WEATHER ROLL ANGLE MEASUREMENT FOR PROJECTILES, Issued on Jan. 25, 2000 by James G. Small, the teachings of which are incorporated herein by reference. The monopulse elements of the antenna enable calculation of the azimuth and elevation position of the projectile in the conventional manner. High accuracy is insured because a 0.1 watt beacon transmitter on the rod can deliver a signal to noise ratio of 50 or 60 dB at the receiver. The receiver/computer 46 outputs projectile azimuth, elevation, range, roll rate and velocity information to a processor 47 which uses these inputs to calculate the trajectory (azimuth and elevation) of the projectile and the impact point thereof in a conventional manner. The projected projectile impact point is compared to the target location (supplied by the target locator 34) by a subtractor 48 which outputs an error signal that is used by a second processor 49 to calculate control inputs required to adjust the trajectory of the projectile for a target impact within desired accuracy specifications. Other trajectories, such as command to line of sight may be chosen, as will be recognized by guidance designers. The baseline concept outputs commands to the projectile 30 times per second, matching the input data rate from conventional Forward Looking IR imaging systems. Other command rates could be chosen either to enhance accuracy (higher rate) or reduce cost (lower rate) without departing from the scope of the present teachings. Those skilled in the art will appreciate that the calculations performed by the elements 47, 48 and 49 may be performed by the fire control processor 36.

The control inputs are transmitted to the projectile subsystem 50 by the transmitter 40 and received by a first antenna 51 thereof. The antenna 51 has at least one vertically polarized element 51*a* and at least one horizontally polarized element 51*b*. The antenna 51 provides input to a receiver 52 which communicates the control inputs to a flight control processor 54. The processor 54 adjusts the fins 16 in response to the control inputs after ejection of the projectile in flight.

The receiver also provides an input to a waveform generator 56 which, in turn, in the illustrative embodiment, outputs to a millimeter wavelength, low-power continuous wave transponder/emitter 58 in the base of the projectile 12. Those skilled in the art will appreciate that the present teachings are not limited to the frequency of the transponder 58. Other operating frequencies may be used as may be appropriate for a particular application without departing from the scope of the present teachings.

The transponder 58 communicates with the launch subsystem 30 via an antenna array 59 having elements 59*a* and 59*b*. The output of the array 59 is tracked by the array of small monopulse antennas 44 in the launch vehicle subsystem 30. No clutter should be seen by the antenna 59 and the signal to noise ratio should be high. Highly accurate monopulse data resulting from the high signal to noise ratio is collected and analyzed in pulse sets by a filter in the receiver/computer 46.

Figure 3:
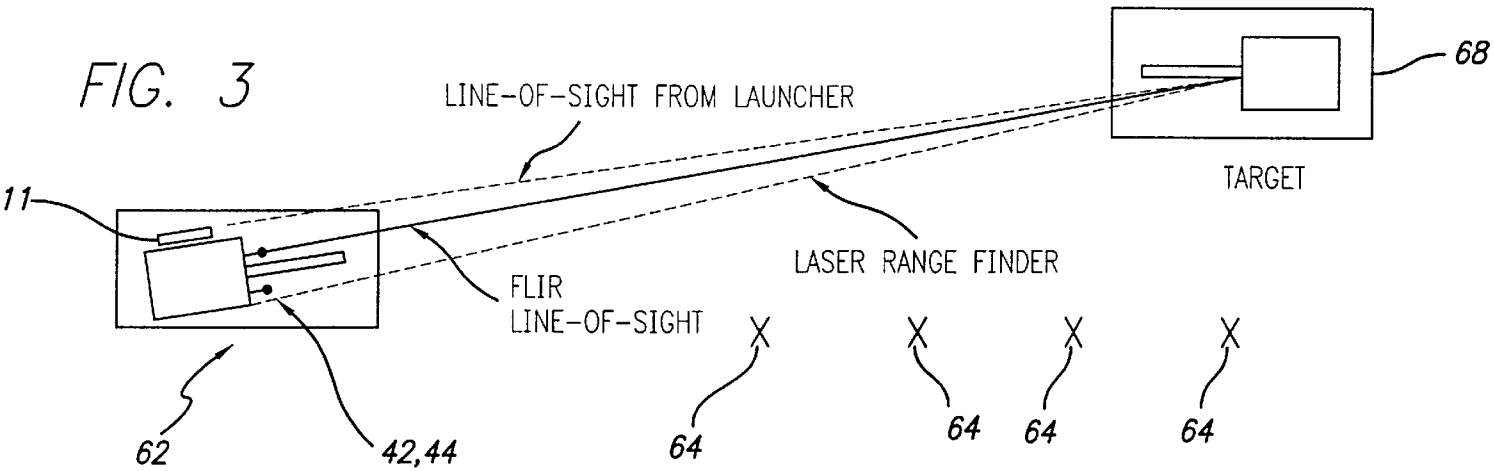
FIG. 3 illustrates the operation of the guidance system of the present invention.

FIG. 3 is a diagram which illustrates the operation of an illustrative embodiment of the guidance system of the present invention. In order to determine the location of the projectile 12 as it travels to the target 68, its range, velocity, and location in azimuth and elevation must be measured. This is accomplished through use of the transmitter 40 on the launcher 62 which is set at a slightly different frequency than that of the projectile 12. The signal modulates the projectile transmitter 58 to blink or shut down with a short turn-off time (a negative pulse) at a non-ambiguous interval. Measurement of the round trip transmit/receive time (minus modulation delay) allows range to the projectile 12 to be determined. Velocity can be obtained through the use of conventional Doppler techniques or by differentiating range. Once obtained, the calculated location of the projectile 12 is periodically compared to the desired impact point that was previously calculated by the fire control system. The command system then calculates the control inputs to change the ballistic trajectory so that the target 48 is impacted.

Because the target location is determined through use of the FLIR and the LRF, the radar guidance system must be calibrated to them. This can be accomplished by placing millimeter wave emitters 64 at a series of ranges and elevations, and adjusting the radar system to coincide with those locations. If electro-optical and radio-frequency (RF) sensors are mounted directly on a rigid turret body, calibration would be maintained for a considerable amount of time, even under combat conditions. Alternatively, the radar guidance system may be calibrated to the IR system while the missile is in flight when the missile is visible simultaneously in both wavelength bands. Then support is not required by an external calibration system and there is a negligible degradation of accuracy with time of flight.

Thus the weapon system of the present invention delivers a long-rod penetrator at hypersonic velocity to an armored tank with at least one-meter accuracy and sufficient energy to destroy the target. The system herein described has the advantage that guidance commands can be transmitted through the motor case exhaust plume, allowing a direct ballistic path to be taken to the target 48. If the target becomes visible to the FLIR and laser ranger while the projectile is in flight, the location may be updated before impact and the projectile trajectory corrected.

The design shown herein maximizes the amount of propellant that can be carried by the rocket motor inside a container/launch tube. Simultaneously, the direct trajectory and the remote RF roll measurement system eliminates a need for an IMU on board the projectile. When divert charges are used for flight control, the diameter of the rod at the tails increases only a small amount over the basic rod diameter. Therefore the drag on the coasting rod is minimized and the inert weight of the complete missile is minimized.

The ratio of the inert weight to the gross weight of the boosted rocket is extremely critical because velocities in excess of 2000 meters per second are required for effective penetration of armor. The table below, calculated for the velocity reached in a vacuum for several fractions of inert weight using a propellant with a specific impulse of 240 seconds, illustrates the importance of low inert weight.

| Inert Fraction | Velocity after Boost (meters per second) |
|---|---|
| 0.5 | 1635 |
| 0.6 | 2159 |
| 0.7 | 2838 |

As illustrated in the table, when the boost impulse is less than one second, the effect of drag is not large.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A projectile guidance system comprising:

first means for determining a target location and providing data with respect thereto;

second means responsive to said data for calculating a ballistic trajectory to said target location; and third means for guiding a hypersonic projectile in flight along an optimal ballistic trajectory to said target location wherein the location of the hypersonic projectile is determined using millimeter wave energy and a roll angle of the hypersonic projectile is determined using a millimeter wave signal from the hypersonic projectile.

2. The invention of claim 1 wherein said hypersonic projectile is a tungsten rod.

3. The invention of claim 1 wherein said first means includes an imaging system.

4. The invention of claim 3 wherein said imaging system is a forward looking infrared imaging system.

5. The invention of claim 3 wherein said first means further includes a system for determining a range to a target from a predetermined location.

6. The invention of claim 5 wherein said system for determining range is a laser range finder.

7. The invention of claim 1 wherein said second means includes a fire control system.

8. The invention of claim 7 wherein said a fire control system includes means for predicting target location.

9. The invention of claim 8 wherein said a fire control system includes an inertial measurement unit.

10. The invention of claim 1 further including a launch platform.

11. The invention of claim 10 wherein said third means includes a missile adapted to carry said hypersonic projectile.

12. The invention of claim 11 further including means for ejecting said hypersonic projectile from said missile during a flight thereof.

13. The invention of claim 12 wherein said missile is a rocket.

14. The invention of claim 12 wherein said missile includes a propulsion system and a guidance means.

15. The invention of claim 14 wherein said guidance means includes a transceiver system mounted on said hypersonic projectile.

16. The invention of claim 15 wherein said transceiver system includes a millimeter wavelength wave emitter.

17. The invention of claim 16 wherein said millimeter wavelength wave emitter is a low-power continuous wave emitter.

18. The invention of claim 17 wherein said third means further includes means mounted at said launch platform for receiving a signal transmitted by said millimeter wavelength wave emitter.

19. The invention of claim 18 wherein said means mounted at said launch platform for receiving a signal transmitted by said millimeter wavelength wave emitter includes an array of antennas.

20. The invention of claim 19 wherein said array of antennas includes monopulse antennas.

21. The invention of claim 19 wherein said means mounted at said launch platform for receiving a signal transmitted by said millimeter wavelength wave emitter further includes filter means for analyzing data in said signal.

22. The invention of claim 18 further including means for determining a location of said hypersonic projectile after a launch thereof.

23. The invention of claim 22 wherein said means for determining a location of said hypersonic projectile includes means located at said launch platform for transmitting a blinking signal to said transceiver system on said hypersonic projectile.

24. The invention of claim 23 wherein said means for transmitting a blinking signal to said transceiver system on said hypersonic projectile operates at a frequency offset slightly from the transmit frequency of said transceiver system on said hypersonic projectile.

25. The invention of claim 23 wherein said means for determining a location of said hypersonic projectile further includes means for measuring a round trip delay of said blinking signal to provide data representative of the range of said hypersonic projectile.

26. The invention of claim 25 wherein said means for determining a location of said hypersonic projectile further includes means for determining the impact point of said hypersonic projectile.

27. The invention of claim 26 further including means for updating a current ballistic trajectory of said hypersonic projectile based on the impact point thereof relative to said target location.

28. The invention of claim 27 wherein said means for updating the current ballistic trajectory of said hypersonic projectile includes means for receiving a signal transmitted from said launch platform and aerodynamic control means responsive thereto.

29. A system for continuously guiding a hypersonic projectile along a ballistic trajectory to a target location, said system comprising:

the hypersonic projectile;

a launch platform;

a fire control system for determining said ballistic trajectory prior to launch;

a millimeter wavelength wave emitter at said projectile for transmitting a signal;

an array of monopulse antennas mounted on said launch platform for receiving the signal from said millimeter wavelength wave emitter and outputting a roll angle of the hypersonic projectile used in a processor for determining a calculated impact point of said hypersonic projectile;

means within said launch platform for comparing said calculated impact point to said target location and generating a guidance signal in response thereto;

means for transmitting a guidance control command to said hypersonic projectile to adjust a current ballistic trajectory of said hypersonic projectile; and means disposed at said hypersonic projectile for receiving said guidance control command and adjusting the current ballistic trajectory thereof to an optimal ballistic trajectory in response thereto.

30. A method for guiding a hypersonic projectile including the steps of:

determining a target location and providing data with respect thereto;

calculating a ballistic trajectory to said target location in response to said data; and guiding said hypersonic projectile in flight along an optimal ballistic trajectory to said target location wherein the location of the hypersonic projectile is determined using millimeter wave energy and a roll angle of the hypersonic projectile is determined using a millimeter wave signal from the hypersonic projectile.

31. The invention of claim 29 further including:

means at said launch platform for sending a modulating signal to a receiver located at the hypersonic projectile to cause the millimeter wavelength emmiter to transmit a negative pulse.

* * * * *

UNITED STATES PATENT AND TRADEMARK OFFICE

CERTIFICATE OF CORRECTION

PATENT NO. : 6,614,012 B2
DATED : September 2, 2003
INVENTOR(S) : Schneider et al.

It is certified that error appears in the above-identified patent and that said Letters Patent is hereby corrected as shown below:

Column 3,
Line 62, replace "30" with -- 30 --.

Signed and Sealed this

Twenty-third Day of March, 2004

JON W. DUDAS
*Acting Director of the United States Patent and Trademark Office*